United States Patent [19]

Baron et al.

[11] 4,056,483

[45] Nov. 1, 1977

[54] PROCESS FOR PRODUCING SYNTHESIS GASES

[75] Inventors: Gerhard Baron, Hofheim; Herbert Bierbach; Carl Hafke, both of Frankfurt am Main; Günter Pockrandt, Bad Homburg, all of Germany

[73] Assignees: Metallgesellschaft Aktiengesellschaft, Frankfurt am Main; Ruhrgas Aktiengesellschaft, Essen, both of Germany

[21] Appl. No.: 704,258

[22] Filed: July 12, 1976

[30] Foreign Application Priority Data

July 18, 1975 Germany ..... 2532197

[51] Int. Cl.[2] ..... C01B 2/02; C10J 3/00

[52] U.S. Cl. ..... 252/373; 48/200; 48/202; 48/206

[58] Field of Search ..... 252/373; 48/206, 202, 48/200

[56] References Cited

U.S. PATENT DOCUMENTS

| | | | |
|---|---|---|---|
| 859,988 | 7/1907 | Smith | 252/373 |
| 1,957,743 | 5/1934 | Wietzel et al. | 252/373 |
| 1,974,125 | 9/1934 | Soelberg | 48/206 |
| 2,546,606 | 3/1951 | Mayland | 252/373 |
| 2,674,525 | 4/1954 | Garbo et al. | 48/206 |
| 2,979,390 | 4/1961 | Garbo | 48/202 |
| 3,086,853 | 4/1963 | Brandberg | 48/206 |
| 3,540,867 | 11/1970 | Baron et al. | 252/373 X |
| 3,723,344 | 3/1973 | Reynolds | 252/373 |
| 3,884,649 | 5/1975 | Mathews | 48/202 |
| 3,951,617 | 4/1976 | Crouch | 252/373 |

FOREIGN PATENT DOCUMENTS

| | | | |
|---|---|---|---|
| 872,726 | 6/1971 | Canada | 252/373 |
| 688,517 | 6/1964 | Canada | 252/373 |
| 679,717 | 2/1964 | Canada | 252/373 |
| 223,986 | 6/1968 | U.S.S.R. | 252/373 |

*Primary Examiner*—Howard T. Mars

*Attorney, Agent, or Firm*—Burgess, Dinklage & Sprung

[57] ABSTRACT

In the production of a synthesis gas comprising carbon monoxide and hydrogen, by a process comprising gasifying a solid fuel under a pressure of about 5–150 bars by a treatment with oxygen and water vapor to produce a water vapor-containing raw gas at a temperature of about 350°–700° C, the improvement which comprises further reacting the water vapor-containing raw gas under a pressure of about 5–150 bars with oxygen in a succeeding reactor to produce an intermediate product gas which leaves the reactor at a temperature between about 800° C and 1400° C, cooling the intermediate product gas, and freeing the intermediate product gas from sulfur compounds. A dust fuel and/or liquid hydrocarbon can be added to the raw gas as such or after prereaction with oxygen, the addition advantageously taking place in the succeeding reactor. The reactor may contain a granular bed of a catalyst such as nickel, cobalt or chromium oxide and/or sulfide, and/or a contact material or catalyst support such as an oxide, spinel or silicate of aluminum and/or magnesium. The bed can be fluidized or otherwise mechanically moved. The resulting gas is suited for use as a starting material in a methanol, ammonia, oxo or Fischer-Tropsch synthesis.

13 Claims, 1 Drawing Figure

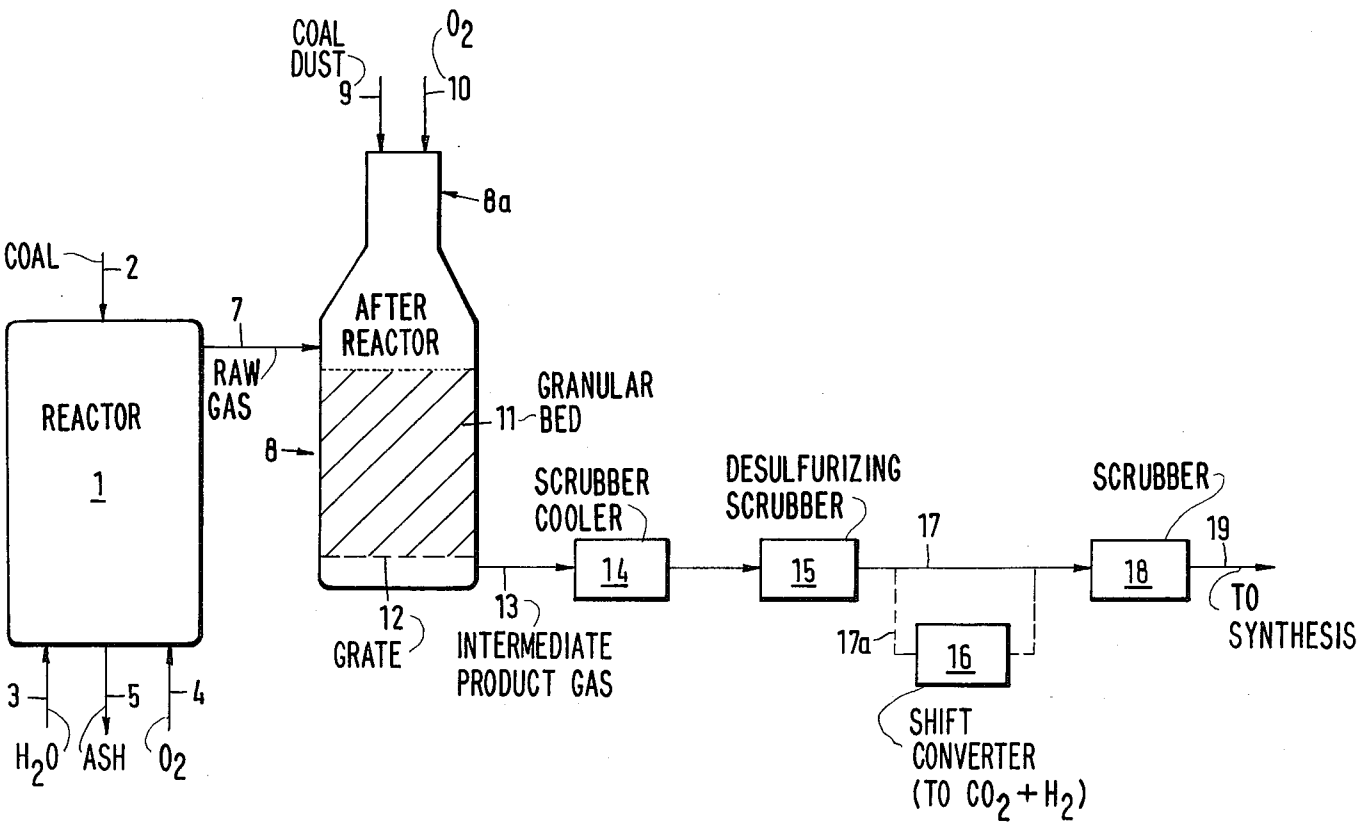
COAL
2
REACTOR
1
3
$H_2O$
5
ASH
4
$O_2$
7
RAW GAS
8
COAL DUST
9
$O_2$
10
8a
AFTER REACTOR
GRANULAR BED
11
12
GRATE
13
INTERMEDIATE PRODUCT GAS
SCRUBBER COOLER
14
DESULFURIZING SCRUBBER
15
17
17a
16
SHIFT CONVERTER (TO $CO_2 + H_2$)
SCRUBBER
18
19
TO SYNTHESIS

PROCESS FOR PRODUCING SYNTHESIS GASES

BACKGROUND

This invention relates to a process of producing synthesis gases, which contain predominantly carbon monoxide and hydrogen, by a gasification of solid fuels, particularly coal, under a pressure of about 5–150 bars by a treatment with free oxygen-containing gas and water vapor and, if desired, additional gasifying agents to produce a water vapor-containing raw gas at a temperature of about 350°–700° C. The synthesis gases may constitute, e.g., starting products for the methanol, ammonia, oxo or Fischer-Tropsch synthesis.

The process is derived from known processes of gasifying coal, including brown coal. A raw gas which can be economically converted to a synthesis gas can be produced particularly by the pressure gasification of coal by a treatment with oxygen and/or air and, as further gasifying agents, water vapor and possible carbon dioxide. A pressure gasification of coal is effected under pressures of 5–150 bars, preferably 10–80 bars, and results in a water vapor-containing raw gas at a temperature of 350°–700° C. pressure gasification of coal is known from numerous publications, such as U.S. Pat. Nos. 3,540,867 and 3,854,895, and German Published Specification DOS No. 2,201,278.

Coal is normally gasified under pressure by a counterflow operation in which the fuel to be gasified and the gasifying agents are fed into the reaction chamber from opposite directions and move in said chamber in opposite directions. That operation has proved desirable because the sensible heat of the product gas is advantageously utilized to heat the fuel to the reaction temperature. In the reactor or gas producer, the fuel travels through several zones. The fuel is dried first and is then degasified in a dry distillation zone before the fuel enters the gasification zone, in which a major portion of the endothermic reactions are carried out. In the combustion zone the remaining fuel is finally reacted to a large extent with the free oxygen and an incombustible residual ash consisting of mineral consitituents is left. The gasifying agent which flows into the reactor receives sensible heat from that ash; this is a special advantage from the aspect of heat economy. Experience has shown that the gasifying agents are suitably supplied at a metered rate which is selected so that the maximum combustion temperature in the reactor is below the melting point of the ash.

In addition to water vapor, the raw gas produced by the pressure gasification of coal contains mainly hydrogen and carbon oxides as well as methane. Numerous further substances, such as condensible hydrocarbons, particularly tar having various boiling ranges, are present in smaller quantities. Whereas these are often considered as valuable constitutents of coal, they are not always desirable. Unless they can be directly used for the production of energy, they must be fed to a further benefication stage, e.g., for hydrogenation. The processing of such substances is often problematic because they become available as a result of a gasification in quantities which are not sufficient for an economical utilization. They are also undesired because they become available together with the aqueous condensate formed from the gaseous constituents during the further processing of the raw gas. A considerable expenditure is required to purify this condensate, which contains not only hydrocarbons but, inter alia, also phenols, fatty acids, and ammonia.

It is an object of the invention to enable a processing of the raw gas and its conversion to a synthesis gas in a simpler manner and at lower costs. This is accomplished in that the water vapor-containing raw gas is reacted under a pressure of about 5–150 bars with free oxygen-containing gases in a suceeding reactor to produce an intermediate product gas, which leaves the reactor at temperatures between about 800° and 1400° C, and this intermediate product gas is cooled and freed from sulfur compounds. As the raw gas is converted to the intermediate product gas, the hydrocarbons contained in the raw gas as well as the distributing phenols, fatty acids, and ammonia are converted mainly to hydrogen and carbon oxides by gasification and cracking and for this reason need not be separated from the raw gas. The reaction to produce the intermediate product gas is suitable effected under the pressure which is also maintained in the reactor for the pressure gasification of coal.

Dust fuels, particularly coal dust, or liquid hydrocarbons, particularly tar and/or tar oil, may preferably be gasified by a treatment with oxygen before or in the reactor for producing the intermediate product gas, and the gasification products may be fed to the reaction for producing the intermediate product gas. Exhaust gases and undesired by-products of other processes can also be processed by such thermal gasification treatment with oxygen. $CO_2$ may be used as one of the gasifying agents in the production of the intermediate product gas.

The thermal gasification of the dust fuels, liquid hydrocarbons, exhaust gases or by-products by a treatment with oxygen results in reaction temperatures of about 900°–1400° C and in a production mainly of hydrogen and carbon monoxide, which subsequently deliver heat to the endothermic reactions carried out in the reactor for producing the intermediate product gas. The thermal gasification may be effected in a separate reactor or in the reactor for producing the intermediate product gas.

The dust fuels to be subjected to the thermal gasification have particle size up to about 2 mm, preferably between about 0.03 mm and 0.3 mm. Liquid hydrocarbons to be subjected to the thermal gasification are first vaporized or formed into a fine spray. Exhaust gases which contain combustible constituents may be used as atomizing agents for dispersing the liquid hydrocarbons or dust fuels.

The reactor for producing the intermediate product gas may be designed in various ways. In the reactor, the starting materials in the form of dust and gas are suitably subjected to centrifugal forces or turbulent conditions of flow. This may be accomplished, e.g., in that the reactor contains internal fixtures or a bed of granular material having a particle size of about 3–80 mm, preferably about 5–30 mm. The granular material may consist of heat-resisting inert material, which serves primarily to agitate the gas and dust particles.

According to a further preferred feature of the process according to the invention, the reactor for producing the intermediate product gas contains catalytically acting substances, such as nickel, cobalt, chromium, or their oxides or sulfides. For this purpose, known catalysts are selected which accelerate the cracking of the gases and vapors to hydrogen and carbon oxides in the reactor for producing the intermediate product gas whereas a formation of carbon black is avoided. Supports for the catalysts may consist of $Al_2O_3$, MgO or mixtures of these two substances as well as silicates of aluminum and/or magnesium. The catalyst support may also consist of aluminum spinel or magnesium spinel. To increase the extent of the reaction in the reactor for producing the intermediate product gas, the granular bed may be carried by a movable grate. Alternatively, the bed may consist of a fluidized bed.

Because the cracking reactions in the intermediate product gas reactor are endothermic reactions, care must be taken that sufficient energy is available for the reaction. To that end, the bulk material contained in the reactor may be periodically removed from the reactor and freed from combustible residues whereafter the bulk material is returned at an elevated temperature to the reactor. At least part of the energy required for the reaction may be supplied by high-frequency fields or electric resistance heating. In most cases, however, it will be possible to supply the required energy by a partial oxidation with the oxygen which is fed.

The process according to the invention will be further described in the accompanying drawing which is a flow sheet of the process.

Referring now more particularly to the drawing, coal, e.g., hard coal or brown coal, is fed through conduit 2 to the gas-producing reactor 1 and is gasified therein. The gasifying agents consisting of water vapor and oxygen are injected through the conduits 3 and 4 into the reactor 1 at the lower end thereof. When it is desired to produce ammonia synthesis gas, the gasifying agents will consist at least in part of air. The ash which is produced by the gasification treatment is withdrawn through conduit 5. The gasification carried out in the reactor 1 is known per se and is effected under a superatmospheric pressure of about 5–150 bars, preferably about 10–80 bars. As a further gasifying agent, $CO_2$ may be fed to the reactor 1 through conduit 3 or 4.

The water vapor-containing raw gas produced by the gasification is at temperatures in the range from about 350°–700° C when it leaves the reactor 1 through conduit 7. This raw gas may be passed through a cyclone for a coarse separation of dust, if this is required. This optional feature is not shown in the drawing. A second reactor 8 for an after-gasification of the raw gas receives the latter from conduit 7, in which the pressure of the raw gas remains substantially unchanged. In the present example, the pressures in the reactors 1 and 8 are the same.

The reactor 8 is fed at its top 8*a* with coal dust through conduit 9 and with oxygen through conduit 10. This coal dust and oxygen interreact in the reactor with production of high temperatures of about 900°–1400° C. The reaction product together with the raw gas from conduit 7 then flow through a bed 11 of inert granular material, such as $Al_2O_3$, which has a particle size in the range up to about 2 mm, preferably about 0.03 to 0.3 mm, and is carried by a grate 12.

The bed 11 serves mainly for an intense agitation of the fluid flowing into the bed so that the extent of reactions between the components of that flowing fluid is increased. The bed alternatively consists of catalytically active material for intensifying the gasification reactions taking place in the reactor 8. The gasification reactions comprise reactions of solid fuels and hydrocarbons and, inter alia, phenols, fatty acids, and ammonia, with oxygen and water vapor to produce mainly hydrogen and hydrocarbons. These gasification or cracking reactions are endothermic reactions.

The reaction in the reactor 8 is so controlled that the resulting intermediate product gas is at a temperature of about 800°–1400° C as it leaves the reactor. The intermediate product gas flows in conduit 13 to a scrubber-cooler 14 and is subsequently fed to a desulfurizing scrubber 15. When a shift conversion is required, part of the desulfurized gas is branched off through the conduit 17*a,* represented by a dotted line, and fed to a shift converter 16, in which CO + $H_2O$ are catalytically converted to $CO_2$ + $H_2$ in known manner, e.g., in accordance with U.S. Pat. No. 3,069,250, in order to increase the hydrogen content of the gas. The shift-converted gas is admixed to the main stream flowing in conduit 17.

The desulfurization in the scrubber 15 may also be carried out in known manner, e.g., by the Rectisol process, in which the gas is scrubbed with scrubbing agents such as methanol at temperatures below about 0° C to remove impurities, mainly sulfur compounds and carbon dioxide. Such scrubbing processes have been described in U.S. Pat. Nos. 2,863,527; 3,531,917; and 3,710,546. The gas which has been desulfurized and, if desired, has been shift-converted in part is then freed from $CO_2$ in scrubber 18 if and to the extent in which this is required in view of the synthesis to which the gas is fed through conduit 19.

The invention will be further described in the following illustrative examples.

EXAMPLE 1

A gas producer having an average diameter of 2.6 m and operated under a pressure of 20 bars is fed with 15 metric tons (t) of coal per hour. The coal has the following compositions based on water- and ash-free matter;

| | | |
|---|---|---|
| Proximate Analysis | | |
| Moisture | 251.9 | kg/t |
| Ash | 298.5 | kg/t |
| Tar | 143.0 | kg/t |
| Water removalbe by dry distillation | 80.3 | kg/t |
| Phenols | 8.0 | kg/t |
| Fatty acids | 1.8 | kg/t |
| Net calorific value | 7,044.5 | kcal/kg |
| Elementary Analysis of Pure Coal | | kg/t |
| C | 762.6 | |
| H | 55.6 | |
| O | 157.4 | |
| N | 10.7 | |
| Cl | 0.3 | |

257 Standard $m^3$ oxygen per metric ton of coal and 5.5 kg water vapor per standard $m^3$ of oxygen are fed as gasifying agents into the gas producer. Raw gas is produced at a rate of 1913 standard $m^3/h$ on a dry basis and has the following composition in percent by volume:

$CO_2$: 28.2
$H_2S$: 0.4
$C_2H_4$: 0.4
CO: 20.1
$H_2$: 38.9
$CH_4$: 11.1
$C_2H_6$: 0.6
$N_2$+Ar: 0.3

The raw gas contains also 0.5 standard $m^3$ water vapor per standard $m^3$ dry gas. The raw gas exit temperature is 600° C.

Cooling of the raw gas to 25° C would make the following by-products available per metric ton of water-and ash-free coal:

Tar: 59 kg
Oil: 32 kg
Gasoline: 16 kg
$NH_3$: 13.6 kg
Phenols: 8 kg
Fatty acids: 1.8 kg The raw gas is fed without cooling to an aftergasification reactor 8 and is reacted therein with 0.15 standard $m^3$ oxygen and 0.4 kg water vapor per standard $m^3$ of raw gas. About one-half of the reactor is filled with alumina balls having an average diameter of 30 mm. The reaction chamber is 2 m in diameter and the alumina balls form a bed 4 m high.

As a result of the reaction in the reactor 8, a temperature of about 1300° C is attained near the oxygen inlet. The gas leaving the reactor is at a temperature of 900° C and has the following composition in percent by volume:

$CO_2$: 25.7
$H_2S$: 0.2
CO: 23.8
$H_2$: 49.3
$CH_4$: 0.4
$N_2$ + Ar: 0.6

This intermediate product gas is free from condensible hydrocarbons and no longer contains free oxygen. The gas is cooled to 40° C in a scrubber-cooler and is then desulfurized by being scrubbed with liquid methanol at about −25° C, whereby about one-half of the $CO_2$ content is also removed. When the gas has been reheated to 350° C, it is shift-converted in contact with a catalyst consisting of iron oxides. The gas is scrubbed with hot potassium carbonate solution (or with monoethanolamine or methanol) to remove the $CO_2$ and is then scrubbed with liquid nitrogen to remove residual CO and $CH_4$, whereafter the required nitrogen is added. The resulting synthesis gas for the $NH_3$ synthesis has the following composition in percent by volume:

$H_2$: 75.5
$N_2$ + Ar: 24.5

EXAMPLE 2

0.25 Standard $m^3$ oxygen and 0.4 water vapor are added to the raw gas produced in accordance with Example 1 per standard $m^3$ of said raw gas, along with coal dust having a particle size of 0.03–0.3 mm at a rate of 300 kg per metric ton of the lump fuel initially fed to the gas-producing reactor 1. The coal dust has the same analysis as the coal used in Example 1.

Raw gas, oxygen, water vapor, and coal dust are reacted in a reactor 8 such as is diagrammatically shown on the drawing and has been used in Example 1. The resulting intermediate product gas is at a temperature of 950° C as it leaves the reactor 8 and has the following composition in percent by volume:

$CO_2$: 22.9
$H_2S$: 0.3
CO: 29.0
$H_2$: 47.0
$CH_4$: 0.3
$N_2$ + Ar: 0.5

To produce an $NH_3$ synthesis gas, the intermediate product gas is processed further as in Example 1.

The oxygen employed in the foregoing examples was substantially pure but it can be supplied mixed with other gases such as nitrogen, e.g., air.

It will be appreciated that the instant specification and examples are set forth by way of illustration and not limitation, and that various modifications and changes may be made without departing from the spirit and scope of the present invention.

What is claimed is:

1. The production of a synthesis gas comprising carbon monoxide and hydrogen, by a process comprising gasifying coal in a first reaction zone under a pressure of about 5–150 bars in counterflow to oxygen and water vapor to produce a water vapor-containing raw gas having a temperature of about 350° – 700° C, feeding said raw gas without cooling same, into a second reaction zone and reacting it non-catalytically with oxygen under a pressure of about 5–150 bars, said second reaction zone containing a bed of heat-resisting inert granular material having a particle size of about 3–80 mm, withdrawing from said second reaction zone an intermediate product gas having a temperature between about 800° C and 1400° C, cooling the intermediate product gas and freeing it from sulfur compounds.

2. The process according to claim 1, including the step of adding at least one of a dust fuel and liquid hydrocarbon to the water vapor-containing raw gas prior to its further reaction.

3. A process according to claim 2, wherein the dust fuel has a particle size up to about 2mm.

4. A process according to claim 2, wherein a liquid hydrocarbon is vaporized or formed into a fine spray in which form it is added to the water-vapor containing raw gas.

5. The process according to claim 1, wherein exhaust gases comprising combustible material are fed to the second reaction zone with liquid hydrocarbon or dust fuel.

6. A process according to claim 5, wherein the exhaust gas is used as an atomizing agent for dispersing the liquid hydrocarbon or dust fuel which is added to the reactor.

7. The process according to claim 1, wherein said inert granular material is alumina.

8. The process according to claim 1, wherein the bed is mechanically moved.

9. The process according to claim 1, wherein the bed is maintained in a fluidized state.

10. The process according to claim 1, wherein the granular bed material is periodically removed from the second reaction zone, is freed from combustible residues and is returned at elevated temperature into the second reaction zone.

11. The process according to claim 1, wherein at least part of the heat of reaction required in the first reaction zone for producing the intermediate product gas is supplied by a high-frequency electric field or by electric resistance heating.

12. The process according to claim 1, wherein the gasifying agent for gasifying the solid fuel includes carbon dioxide in addition to the oxygen and water vapor.

13. The process according to claim 1, wherein the reaction in the succeeding reactor is carried out in the presence of oxygen gas and carbon dioxide.

* * * * *

UNITED STATES PATENT AND TRADEMARK OFFICE

CERTIFICATE OF CORRECTION

PATENT NO. : 4,056,483

DATED : November 1, 1977

INVENTOR(S) : Gerhard Baron, et al

It is certified that error appears in the above-identified patent and that said Letters Patent are hereby corrected as shown below:

TITLE PAGE : delete Figure at the bottom thereof.

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*